US012302978B2

(12) United States Patent
Lathrop

(10) Patent No.: US 12,302,978 B2
(45) Date of Patent: May 20, 2025

(54) BREAKAWAY VISOR

(71) Applicant: Western Power Sports, LLC, Boise, ID (US)

(72) Inventor: Jeremy Len Lathrop, Meridian, ID (US)

(73) Assignee: Western Power Sports, LLC, Boise, ID (US)

( * ) Notice: Subject to any disclaimer, the term of this patent is extended or adjusted under 35 U.S.C. 154(b) by 140 days.

(21) Appl. No.: 17/980,112

(22) Filed: Nov. 3, 2022

(65) Prior Publication Data

US 2024/0148099 A1 May 9, 2024

(51) Int. Cl.

| | |
|---|---|
| ***A42B 3/22*** | (2006.01) |
| ***A42B 3/32*** | (2006.01) |
| ***A42B 7/00*** | (2006.01) |

(52) U.S. Cl.

CPC ..... *A42B 3/32* (2013.01); *A42B 3/227* (2013.01); *A42B 7/00* (2013.01)

(58) Field of Classification Search

CPC .. A42B 3/32; A42B 3/227; A42B 7/00; A42B 3/222; A42B 3/223

See application file for complete search history.

(56) References Cited

U.S. PATENT DOCUMENTS

| | | | | |
|---|---|---|---|---|
| 2,763,005 A | | 9/1956 | Richter | |
| 4,584,721 A | * | 4/1986 | Yamamoto | A42B 3/245 219/203 |
| 4,744,107 A | | 5/1988 | Fohl | |
| 4,813,083 A | | 3/1989 | Davidson | |
| 5,469,584 A | * | 11/1995 | Casartelli | A42B 3/227 2/424 |
| 6,622,314 B1 | * | 9/2003 | Kim | A42B 3/222 2/424 |
| 10,070,677 B2 | | 9/2018 | Durham et al. | |
| 11,026,467 B2 | | 6/2021 | Durham et al. | |
| 2017/0367425 A1 | * | 12/2017 | Chen | A42B 3/042 |
| 2020/0275725 A1 | | 9/2020 | Mazzarolo et al. | |
| 2022/0047030 A1 | * | 2/2022 | Summersett | A42B 3/22 |

FOREIGN PATENT DOCUMENTS

| | | |
|---|---|---|
| DE | 8604646 U1 | 4/1986 |
| DE | 3604813 C1 | 10/1987 |
| DE | 102006020134 B3 | 2/2008 |

(Continued)

OTHER PUBLICATIONS

Steelbird Air Irridium Blue Visor, Steelbird Air, 3 Pages, URL: http://www.steelbirdhelmet.com/product/467/3/steelbird-air-irridium-blue-visor.

(Continued)

*Primary Examiner* — Khoa D Huynh
*Assistant Examiner* — Erick I Lopez
(74) *Attorney, Agent, or Firm* — Lowe Graham Jones PLLC

(57) ABSTRACT

The present disclosure relates to a breakaway visor. The visor comprises a central portion and a side portion extending from each side of the central portion. The side portion includes a side coupling mechanism having an opening to receive a screw to couple the visor with a side part of a helmet. In event of exertion of an external force, the visor is configured to be detached from the helmet without being broken.

32 Claims, 13 Drawing Sheets

(56) References Cited

FOREIGN PATENT DOCUMENTS

| | | | |
|---|---|---|---|
| FR | 3079720 | B1 | 9/2020 |
| JP | 2015168890 | A | 9/2015 |
| SE | 539137 | C2 | 11/2016 |

OTHER PUBLICATIONS 7 of the Best Lightweight Full Face Helmets | Vital MTB Roundup—Mountain Bikes Feature Stories—Vital MTB, 23 Pages, URL: https://www.vitalmtb.com/features/7-of-the-Best-Lightweight-Full-Face-Helmets-Vital-MTB-Roundup,2616.

Coron Air Spin Fabio Ed., POC Sports, 6 Pages, URL: https://na.pocsports.com/products/coron-air-spin-fabio-ed?utm_medium=organic&utm_source=redirect&variant=36593481416856.

* cited by examiner

BREAKAWAY VISOR

FIELD OF THE DISCLOSURE

The present disclosure generally relates to a visor for attachment to a helmet. More particularly, the present disclosure relates to a breakaway visor that can non-destructively break away from a helmet.

BACKGROUND

Helmets are widely used in different professions and activities, such as in mining and construction work, in sports events, or simply during riding a vehicle on the roads or in off-road riding. The main purpose of using the helmet is to provide safety and to minimize damage or injury caused to a wearer of the helmet/a rider of a vehicle. Generally, a helmet includes different components, such as an outer shell, a multi-layer padding arrangement, a visor, a chinstrap, and the like, for providing safety. All such components provide different types of protections to the wearer/rider/driver/passenger.

Amongst which, visors are used for providing protection to the wearer from the weather, such as sunlight or rain, and from different unwanted materials, such as flying debris, dust, and the like. The visors also deflect brush and branches in the woods. In sports events, the visors are also used to provide protection from roost (flying dirt, rocks, and/or other debris) propelled from rear tires of riders in front. Such visors prevent the unwanted materials from reaching the follower's head, especially the face and eyes of the wearer/rider, preventing distraction and/or injuries to face of the wearer/rider from such materials. Currently, different visors having different attachment mechanisms are used. In some examples, the visors have an opening to receive fasteners, such as screws, for attachment with the helmet. The visors may be rigidly attached to the helmet. In the event of an impact or accident, such as when the rider strikes the ground, such visors are affected, often resulting in breaking of the visor or, more likely the visor attachment. In some cases, removal of the visor from the helmet is favorable as it may lessen the torque applied to the head of the wearer. In any case, the visor might not be fully functional after an impact. Some visors include magnetic fasteners for attachment with the helmet so as to avoid visor damage in a fall while reducing torque on the head of the wearer. However, while such visors are easily detachable from the helmet, they tend to be detached even in case of an application of a small value of external force such as vibration or a bump with the rider's hand while riding.

SUMMARY OF THE DISCLOSURE

In some embodiments, the present disclosure sets forth a visor for attachment to a helmet. The visor includes a central portion and side portions extending from each side of the central portion. The central portion has a forward edge and a rearward edge. Each side portion includes an inner surface, an outer surface, a proximal portion, and a distal portion. The proximal portion extends from a corresponding side of the central portion. The distal portion comprises a side coupling mechanism for attachment with the helmet. The side coupling mechanism has an opening and at least one partial flange in the at least a first portion of the opening.

The at least one partial flange may extend between the inner surface and the outer surface of the side portion. The at least one flange may comprise a first edge having a first inner diameter, a second edge having a first outer diameter, and a first curved surface extending between the first edge and the second edge. The first curved surface may be configured to have a first curve.

In at least one embodiment, the opening may comprise at least one cut-out portion extending between the inner surface and the outer surface. The at least one cut-out portion extends between the outer surface and the inner surface, and comprises a first cut-out edge having a second inner diameter, a second cut-out edge having a second outer diameter, and a second surface extending between the first cut-out edge and the second cut-out edge.

In some embodiments, the present disclosure further relates to a visor for securement to a helmet. The visor comprises a central portion, a right-side member, and a left-side member extend outwardly from a right side and a left side, respectively, from the central portion. Each of the right-side portion and the left-side portion includes an opening to receive a screw therewithin. The opening includes a partial flange having an inner diameter and an outer diameter. The inner diameter is positioned towards the inner surface and the outer diameter is positioned towards the outer surface of the opening. The inner diameter is configured to be smaller than the outer diameter.

BRIEF DESCRIPTION OF THE DRAWINGS

A more complete understanding of the present disclosure may be derived by referring to the detailed description and claims when considered in connection with the Figures, wherein like reference numerals refer to similar elements throughout the Figures.

DETAILED DESCRIPTION

The following description is of exemplary embodiments of the invention only, and is not intended to limit the scope, applicability, or configuration of the invention. Rather, the following description is intended to provide a convenient illustration for implementing various embodiments of the invention. As will become apparent, various changes may be made in the function and arrangement of the elements described in these embodiments without departing from the scope of the invention as set forth herein. It should be appreciated that the description herein may be adapted to be employed with alternatively configured devices having different shapes, components, attachment mechanisms, and the like and still fall within the scope of the present invention. Thus, the detailed description herein is presented for purposes of illustration only and not of limitation.

Reference in the specification to "one embodiment" or "an embodiment" is intended to indicate that a particular feature, structure, or characteristic described in connection with the embodiment is included in at least an embodiment of the invention. The appearances of the phrase "in one embodiment" or "an embodiment" in various places in the specification are not necessarily all referring to the same embodiment.

Embodiments of the present disclosure describe a helmet having different components such as an outer shell, two sides, a multi-layer padding arrangement, a chinstrap, and a visor. The visor may be attached to the two sides of the helmet and may include a top central portion and two side parts, more particularly a first side part and a second side part. The visor is attached with each side of the helmet and a central portion using a coupling arrangement. The coupling arrangement may include a side coupling mechanism and a central attachment. The visor may include components attached together therewith to form an integral coupling assembly. Components described herein may be integral or unitary for lower-cost construction, increased structural integrity, increased performance, and/or efficiencies. Further, components described herein may be utilized for helmets used while riding different vehicles. For example, the visor may be attached to different models of helmet for providing protection against different external conditions. The coupling mechanism of the visor may be utilized to detach the visor from their respective positions at each side of the helmet on external impact or accident. In addition, the coupling arrangement, i.e., the central attachment and the coupling mechanism, of the visor is simple so that a wearer of the helmet or a rider of a vehicle may easily attach/detach the visor to/from the helmet without any additional tools.

Figure 1:
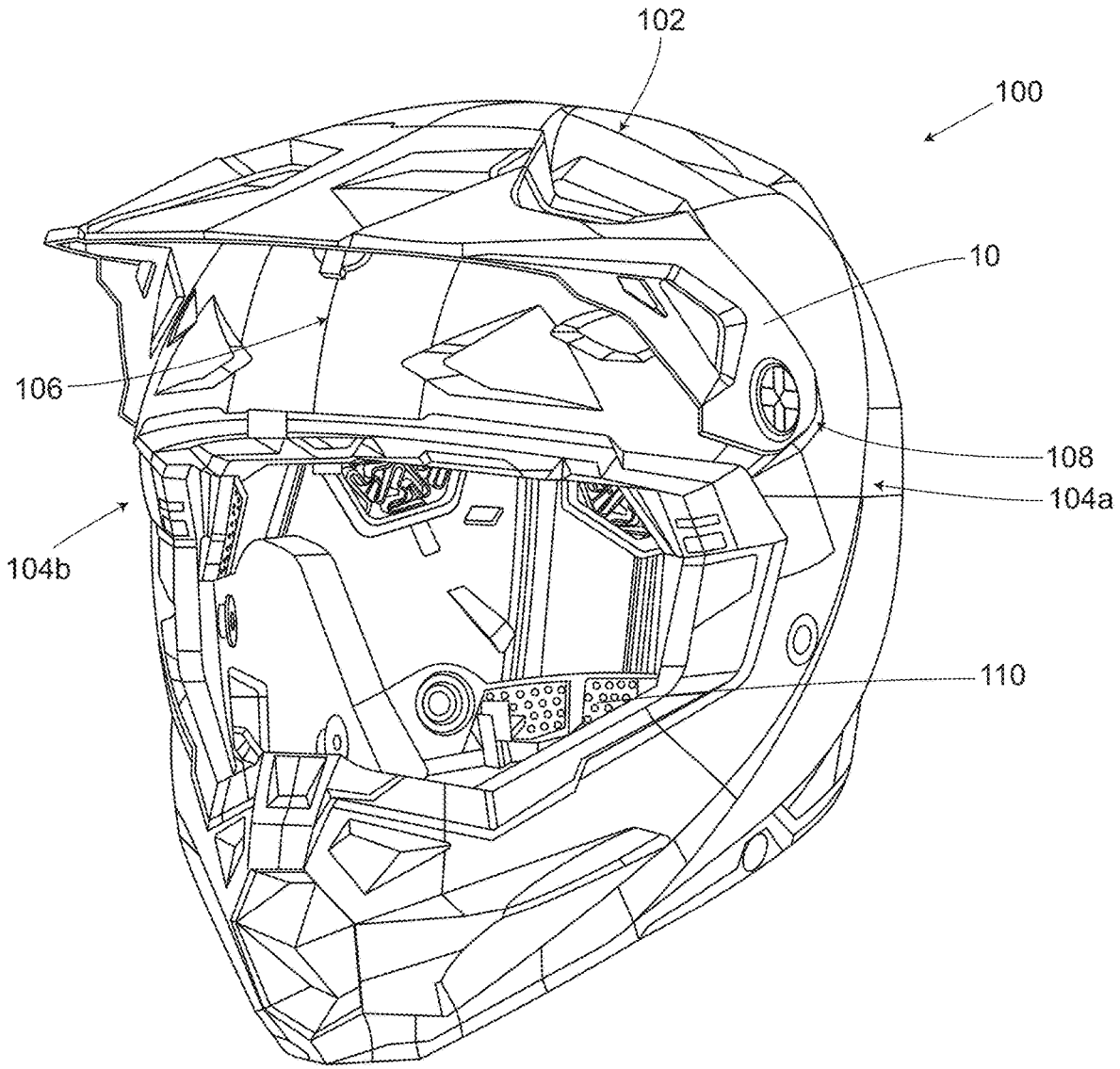
FIGS. 1-2 illustrate an exemplary helmet in accordance with the present disclosure.
Figure 2:
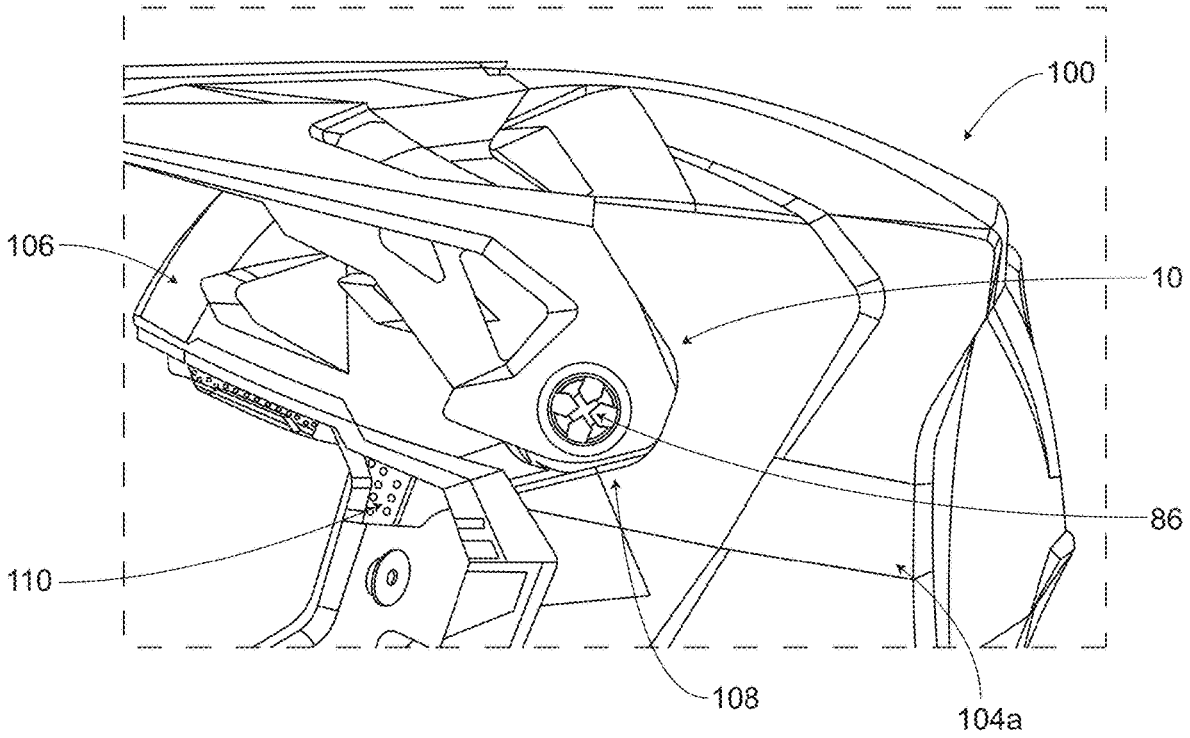

Reference is made to FIGS. 1-2, which represents a helmet 100 according to some embodiments of the present disclosure. The helmet 100 includes an outer shell 102, a padding arrangement 110, two side parts (a first side part 104*a* and a second side part 104*b*), a top central part 106, a coupling arrangement 108 to receive visor 10 at each of the side parts, and a visor 10 attached therewith. The visor 10 may be attached to the top central part 106 and each of the two side parts 104*a*, 104*b* of the helmet 100.

Figure 3:
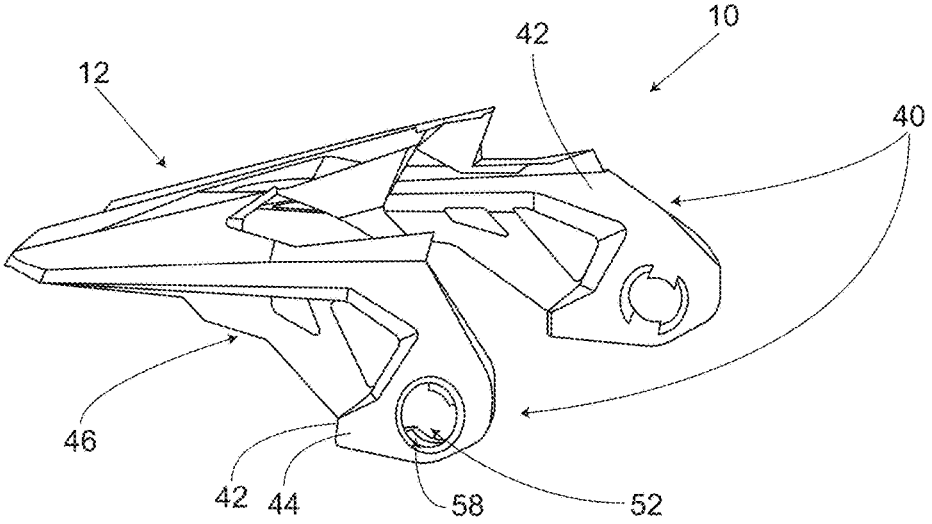
FIG. 3 illustrates an exemplary side isometric view of a standalone visor in accordance with the present disclosure.

FIG. 3 illustrates an exemplary visor 10 for attachment with a helmet 100 in accordance with the present disclosure. The visor 10 may be attached to a top central part 106 and each of two side parts of the helmet 100 using the coupling arrangement 108. The visor 10 may be configured to be attached to the helmet 100 at a corresponding arrangement at the top central part 106 and at each of the two side parts 104*a*, 104*b* (seen e.g., in FIG. 1). The visor 10 may be configured to be easily detached from the corresponding arrangement in event of an impact to the helmet 100 or in presence of an external force without being broken. The visor 10 may further be configured to be attached to the same helmet or another helmet at the corresponding arrangement thereof after such detachment. Accordingly, the visor 10 in accordance with the present disclosure is re-usable and/or re-attachable visor.

The visor 10 comprises a central portion 12 and two side portions 40 extending from a corresponding side of the central portion 12. In an embodiment, the two sides correspond to a left side and a right side of the central portion 12. Accordingly, the two side portions 40 extend from the left side and the right side of the central portion 12. The two side portions 40 are configured to extend outwardly from each side of the central portion 12. In an embodiment, the two side portions 40 extend downwardly from each side of the central portion 12. Accordingly, the two side portions 40 of the visor 10 are configured to be attached to the side parts, more specifically to the first side part 104*a* and the second side part 104*b* of the helmet 100.

Each of the side portions 40 comprises an inner surface 42 and an outer surface 44 opposite to the inner surface 42. The side portion 40 further comprises a proximal portion 46 and a distal portion 48 (seen e.g., in FIG. 4). Accordingly, the inner surface 42 and the outer surface 44 extend from the proximal portion 46 to the distal portion 48. The proximal portion 46 is configured to be extended from a corresponding side of the central portion 12. The distal portion 48 represents a rearward part of the side part. In an embodiment, the visor 10 is configured to be coupled to each of the first side part 104*a* and the second side part 104*b* of the helmet 100 at the distal portion 48.

Figure 5:
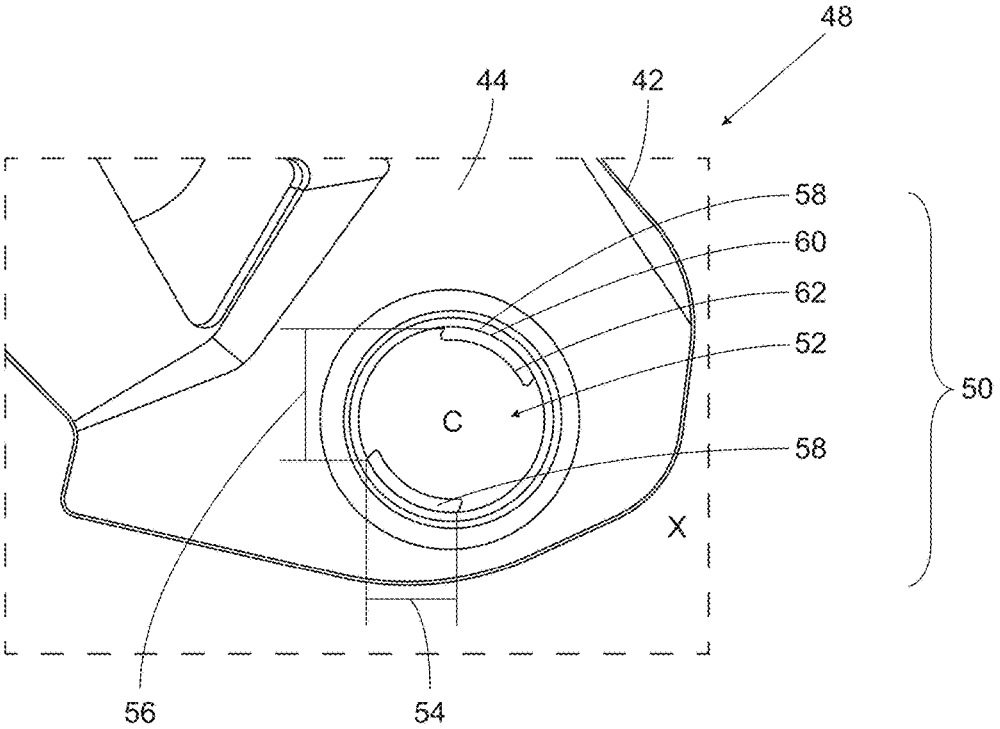
Figure 6:
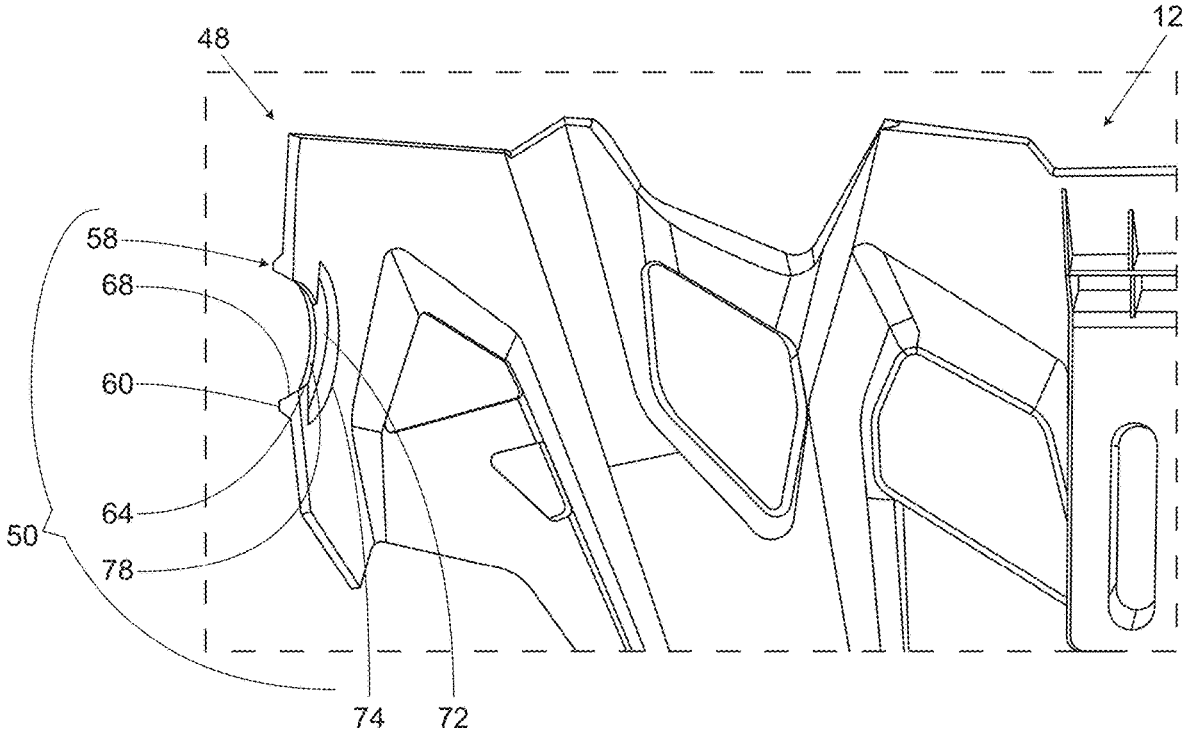
Figure 7:
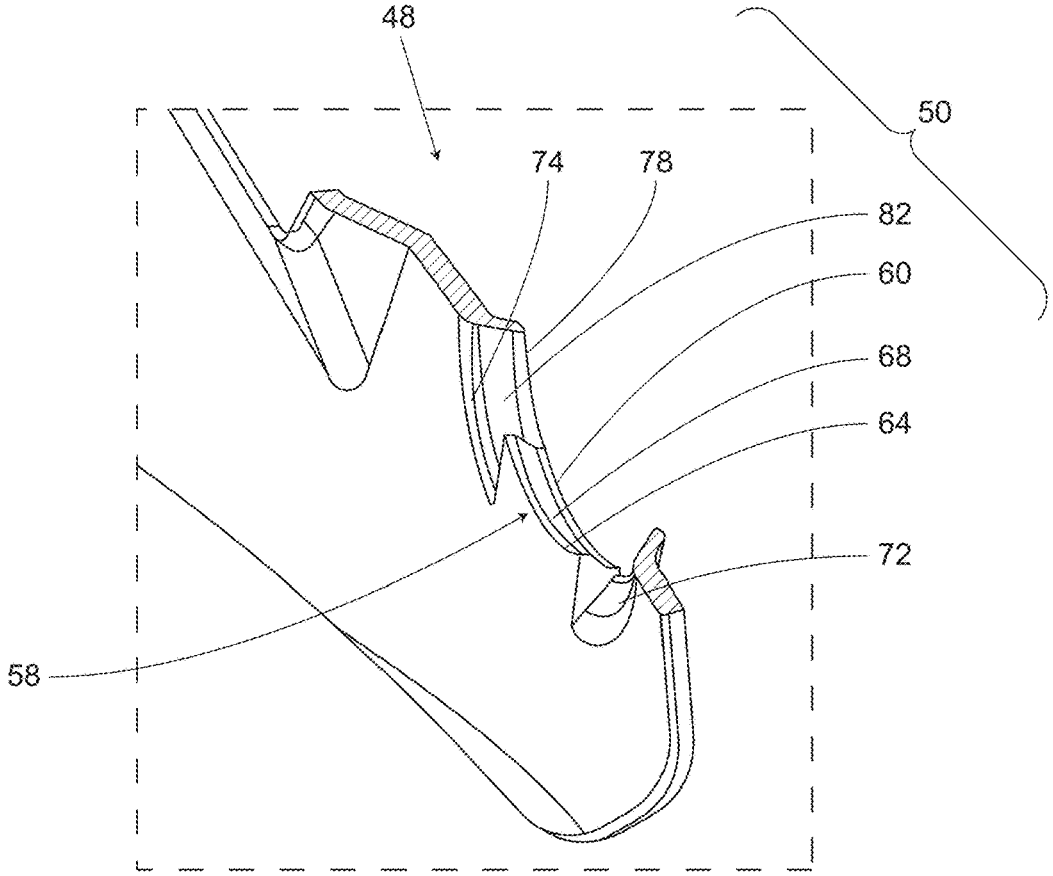

The distal portion 48 comprises a side coupling mechanism 50 (seen e.g., in FIG. 5-7) for attachment with the corresponding arrangement at each of the first side part 104*a* and the second side part 104*b* of the helmet 100. The side coupling mechanism 50 comprises an opening 52 extending between the inner surface 42 and the outer surface 44. For exemplary purpose, a shape of the opening 52 is considered as a circular shape throughout the present disclosure. However, the shape of the opening may be an oval or other non-circular shape. It is to be noted that the opening may be of different shapes for attachment with the helmet without departing from the scope of the present disclosure. The opening 52 of the present disclosure may have a first diameter, a circumference, and a center C. The center C of the opening 52 may pass through an imaginary axis X as illustrated in FIG. 5. Accordingly, the imaginary axis X is perpendicular or substantially perpendicular to the first diameter of the opening 52. In case the opening is of an oval shape, the opening may comprise two partial diameters having two partial diameters. The two partial diameters may be perpendicular or substantially perpendicular to the imaginary axis X.

The opening 52 further comprises at least one partial flange 58 (seen e.g., in FIGS. 3-7). The at least one partial flange 58 may be configured to cover at least a first portion 54 of the opening 52. The opening includes a perimeter and an open central area having a middle. The at least one partial flange 58 comprises a first edge 64 corresponding to the inner surface 42 of the side portion 40. The first edge 64 forms a portion of a circle and may have a first inner diameter corresponding to the inner surface 42. The at least one partial flange 58 further comprises a second edge 60 corresponding to the outer surface 44 of the side portion 40. The second edge 60 forms a portion of a circle and may have a first outer diameter corresponding to the outer surface 44. In an embodiment, the first inner diameter is low as compared to the first outer diameter. In an embodiment, the first edge is closer to the middle of the open central area than the second edge. The at least one partial flange 58 further comprises a first curved surface 68 extending between the first edge 64 and the second edge 60. The first curved surface 68 may be configured to have a first curve (seen e.g., FIGS. 6-7). In an exemplary embodiment, the first curve is a first convex curve between the first edge 64 and the second edge 60. Accordingly, the opening 52 comprises the first curve (i.e., the first convex curve) at the first portion 54 corresponding to the at least one partial flange 58. In some embodiments, as the partial flange 58 circumscribes the first portion 54 of the opening 52, the at least one partial flange 58 may circumscribe at least the first portion 54 of the circumference of the opening 52. In an exemplary embodiment, the partial flange 58 may circumscribe the first portion 54 of the opening 52 having less than a half of the circumference thereof. In some embodiments, the partial flange 58 has a length extending in a circumferential direction that is greater than a thickness of the partial flange, the thickness extending in the direction of the inner surface to the outer surface. In some embodiments, the length of the partial flange 58 is at least twice the thickness. In some embodiments, the at least one partial flange 58 comprises at least two opposing flanges within the opening 52 (seen e.g., in FIG. 5). Such two opposing flanges may be placed substantially at opposite portions of the opening 52. It is to be noted that the two partial flanges are illustrated for exemplary purpose, however the opening 52 may have any number of flanges, for instance single flange or more than two flanges, without departing from the scope of the present disclosure.

Figure 8:
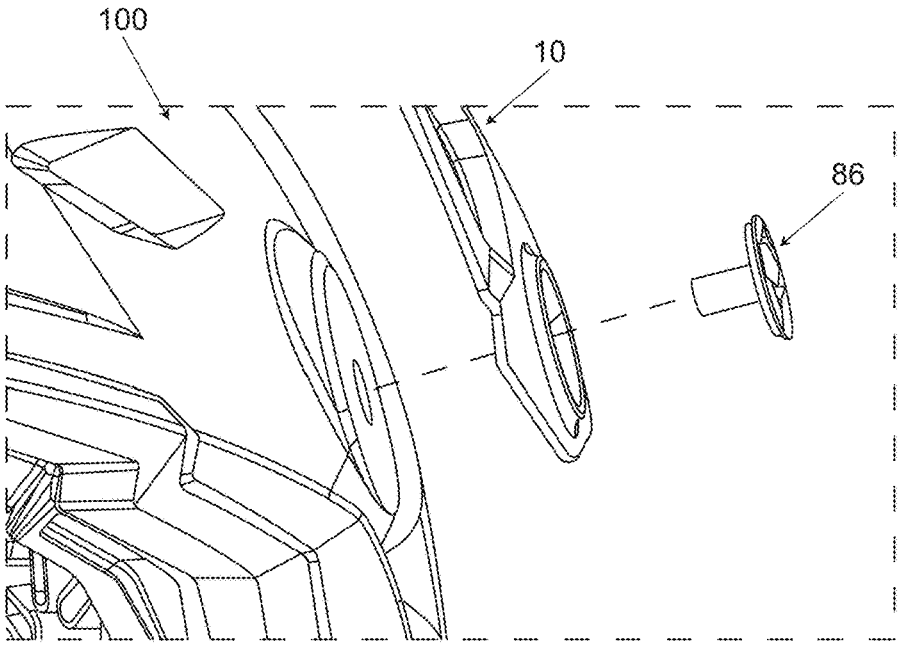
FIG. 8 illustrates an exemplary exploded view of the side coupling mechanism at a side portion of a visor in accordance with the present disclosure.
Figure 9:
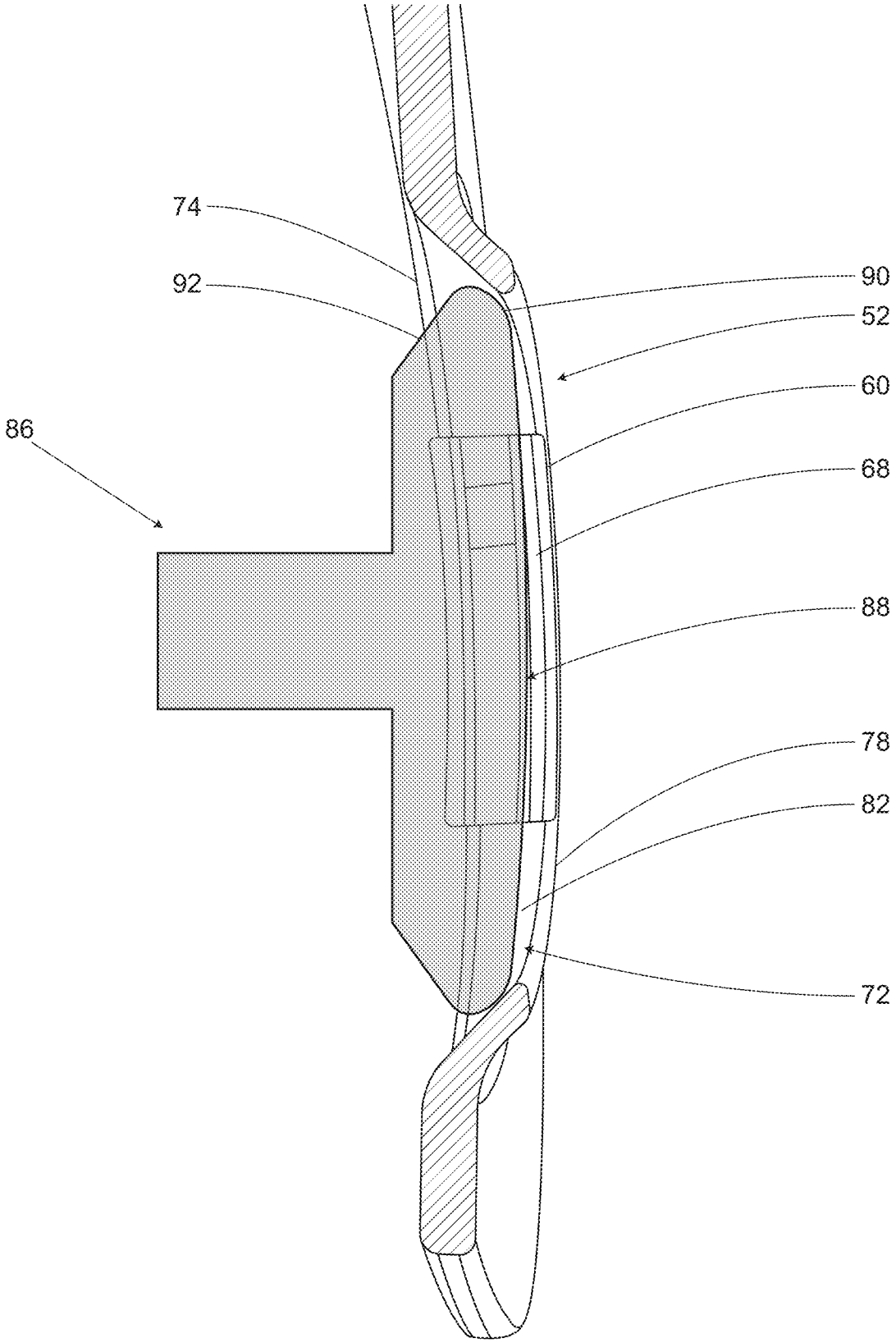
FIG. 9 illustrates an exemplary attachment of a screw in a side coupling mechanism at a side portion of a visor in accordance with the present disclosure.

The opening 52 is configured to receive a screw 86 therewithin (seen e.g., in FIG. 8). Particularly, the at least one partial flange 58 is configured to receive the screw 86 therewithin. More particularly, a screwhead 88 of the screw 86 is configured to be received within the at least one partial flange 58. In other words, the visor 10 is configured to be attached to the helmet 100 via the screw 86. In some embodiments, the screw 86 may further include a shank and a threaded rod. The threaded rod may be attached with a corresponding attachment of the helmet 100. The corresponding attachment of the helmet 100 may comprise a threaded cavity having threads corresponding to threads of the threaded rod of the screw 86. Such attachment of the visor 10 with the helmet 100 using the screw 86 provides secure attachment of the visor 10. An exemplary screw received within the opening 52 is illustrated in FIG. 9.

In an embodiment, the visor 10 may be attached to the helmet 100 by receiving the screw 86 within the partial flange 58 first. In such embodiment, the opening 52 of the visor 10 is configured to be aligned with the corresponding arrangement at the first side part 104*a* or the second side part 104*b* of the helmet 100. In such alignment, the threaded rod of the screw 86 is configured to be comfortably received within the arrangement of the helmet 100. The screw 86 is then rotated the secure attachment. In an embodiment, the screw 86 is configured to be rotated a clockwise direction. Optionally, the screw 86 is configured to be rotated an anticlockwise direction. Accordingly, after tightening the screw 86, the side portion 40 of the visor 10 is attached to the corresponding side part of the helmet 100.

In another embodiment, the screw 86 may be tightened to the helmet 100 first. In such embodiment, the threaded rod of the screw 86 is aligned to the threaded attachment of the corresponding side part of the helmet 100 and the screw 86 is tightened by rotating the same. As explained hereinabove, the screw 86 may be rotated in a clockwise direction or an anticlockwise direction for tightening. After tightening the screw 86 with the helmet 100, the visor 10 is configured to be coupled to the screw 86 at the distal end 28, more particularly at the opening 52, by a push force. Hence, the at least one partial flange 58, and hence the opening 52, may be attached to the helmet 100 by pushing in the opening 52 against the screwhead 88 of the screw 86. In other words, the distal portion 48 of the side portion 40 of the visor 10 may be attached to the screw 86 using a snap fit. A wearer/rider may apply a push force at the distal portion 48 such that the screw 86 is received within the at least one partial flange 58, and hence within the opening 52 to attach the visor 10 with the helmet 100 by the snap fit. Accordingly, the distal portion 48 is configured to be pushed-in to receive the screw 86 within the opening 52. The attachment of the screw 86 with the at least one partial flange 58 ensures connection between the visor 10 and the helmet 100. Such arrangement makes attachment of the visor 10 with the helmet 100 easy and quick. Further, no additional tools or components are required for such attachment. Hence, the wearer/rider may easily and quickly attach the visor 10 to the helmet 100.

The screwhead 88 of the screw 86 may comprise a first screwhead curved surface 90 and a second screwhead curved surface 92. When the visor 10 is attached to the helmet 100 via the screw 86, the second screwhead curved surface 92 corresponds to the first curved surface 68 of the at least one partial flange 58. In other words, when the screw 86 is received within the opening 52, the first screwhead curved surface 90 abuts or coincides with first curved surface 68 of the at least one partial flange 58. Accordingly, the screwhead 88, and hence the screw 86, is configured to be supported within the opening 52 by the first curved surface 68 having secure attachment as seen in FIG. 9.

In some embodiments, the opening 52 may further comprise at least one cut-out portion 72 (seen e.g., in FIGS. 4, 6-7, and 9). The at least one cut-out portion 72 may be configured to cover at least a second portion 56 of the opening 52. The second portion 56 of the opening 52 may be a remaining portion other than the first portion 54. The second portion 56 may be a full or, optionally, a partial portion of the remaining portion of the opening 52. The at least one cut-out portion 72 comprises a first cut-out edge 74 corresponding to the inner surface 42 of the visor 10 and a second cut-out edge 78 corresponding to the outer surface 44 of the visor 10. The at least one cut-out portion 72 further comprises a second surface 82 extending between the first cut-out edge 74 and the second cut-out edge 78. In some embodiments, the second surface 82 is a flat surface extending between the first cut-out edge 74 and the second cut-out edge 78. The second surface 82 may be defined by a second curved surface. The slope of the surface can be any angle from the face of the side of the visor, in some embodiments about 45 degrees, although it need not be a constant slope as it can be convex or concave or multicurved. The slope may be between about 10 degrees and 80 degrees, more preferably between 20 degrees and 70 degrees. In such embodiment, the second curved surface comprises a second curve, and more particularly, a second convex curve. The opening 52, in such embodiment, comprises the second curve (i.e., the second convex curve) at the second portion 56 corresponding to the at least one cut-out portion 72 therein. When the screw 86 is received within the opening 52, the first screwhead curved surface 90 of the screw corresponds to the second surface 82 of the at least one cut-out portion 72. In other words, when the screw 86 is received within the opening 52, at least a partial portion of the first screwhead curved surface 90 abuts or coincides with the second surface 82 of the at least one cut-out portion 72 as seen in FIG. 9.

Figure 4:
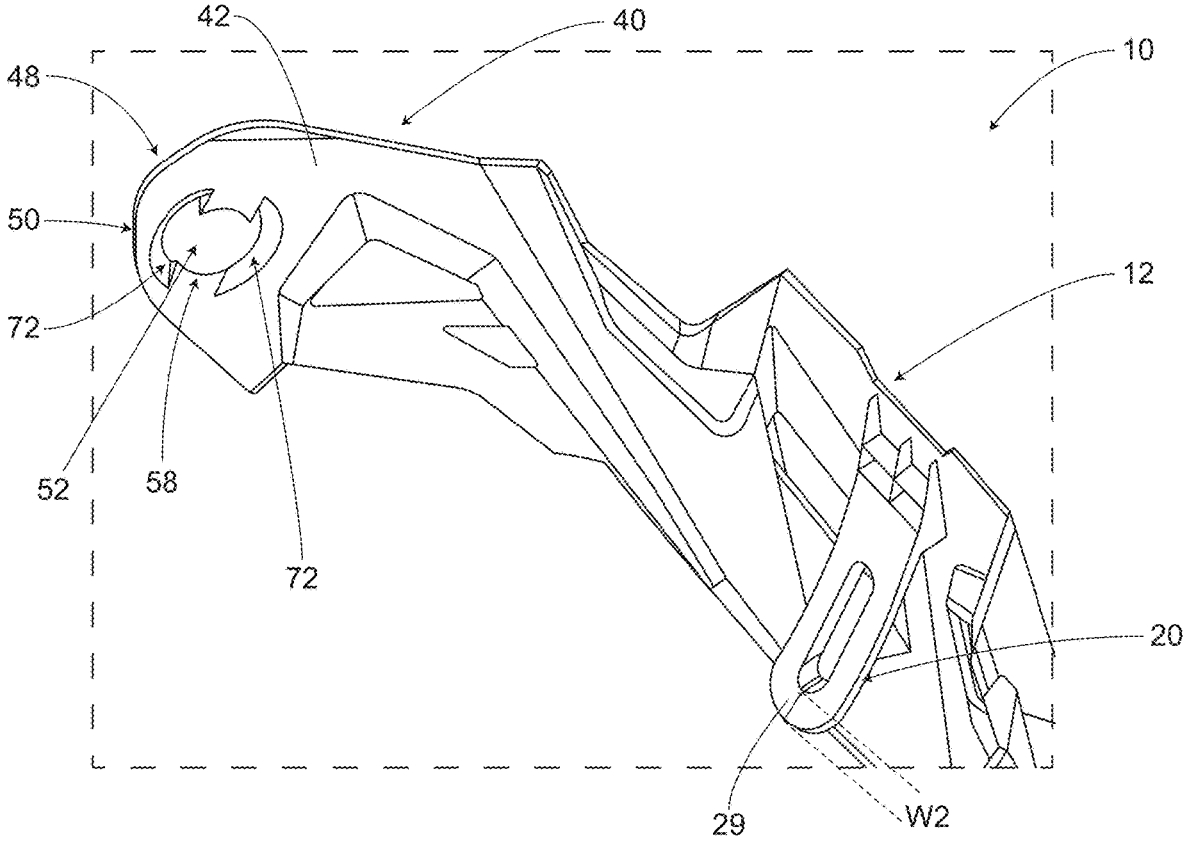
FIGS. 4-7 illustrate exemplary views of an opening at a side portion of a visor in accordance with the present disclosure.

In some embodiments, the opening 52 may have two cut-out portions placed substantially opposite to each other within the opening 52 as illustrated in FIG. 4. Further, in such embodiments, the first convex curve at the at least one partial flange 58 and the second convex curve at the at least one cut-out portion 72 of the opening 52 complement each other. In other words, if the first convex curve opens from the outer surface 44 of the side portion 40, the second convex curve opens from the inner surface 42 side portion 40. The at least one cut-out portion 72 is configured to facilitate easy detachment of the visor 10 as will be explained hereinbelow.

Figure 10:
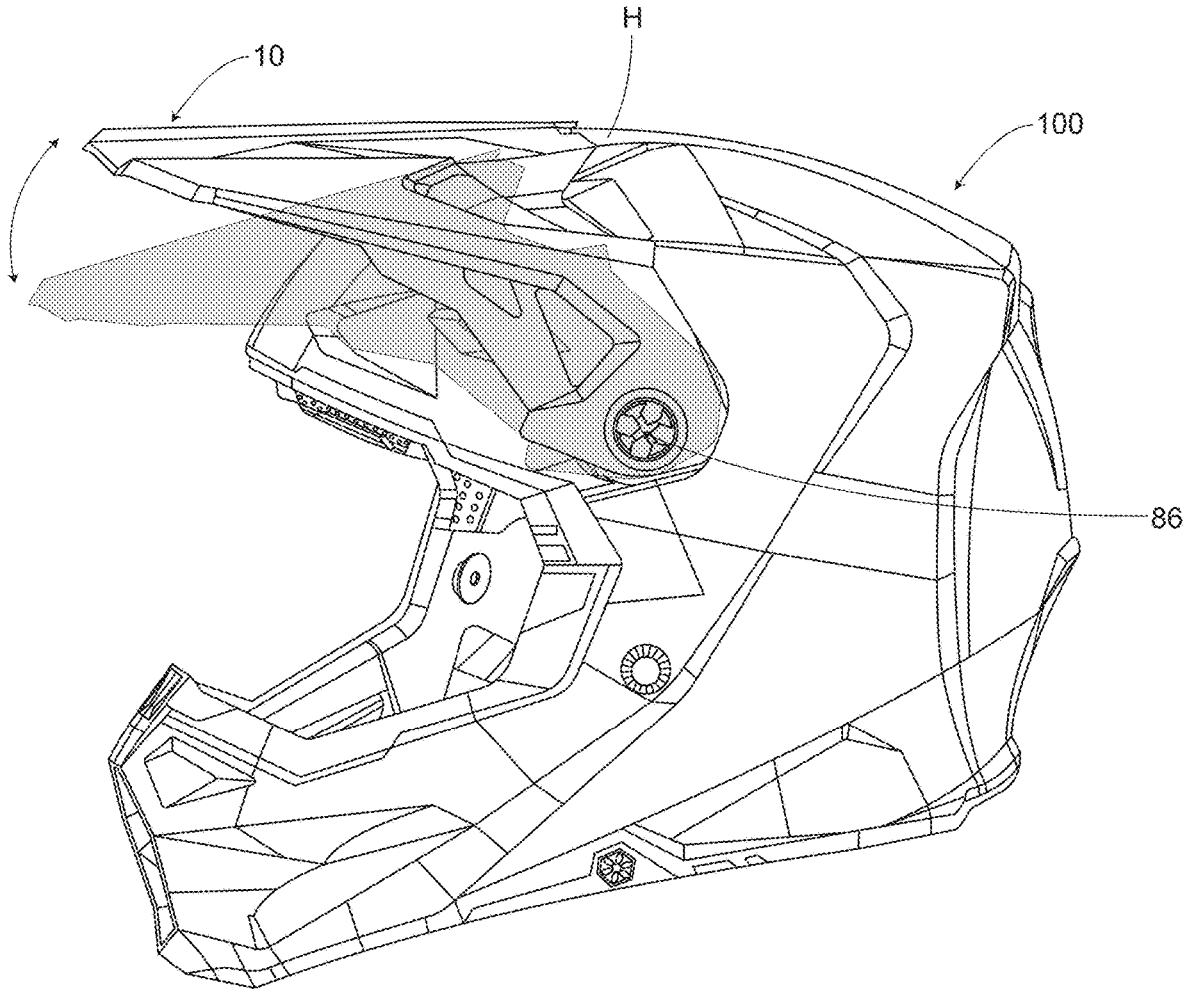
FIG. 10 illustrates an exemplary rotation of a visor in a helmet in a normal condition in accordance with the present disclosure.

The visor 10 is configured to be rotated while being attached to the helmet 100. In a normal condition, the visor 10 is configured to rotate between $10^0$-$25^0$ having attached to the helmet 100 (as seen e.g., in FIG. 10). More particularly, the visor 10 is configured to be rotated between $15^0$-$20^0$. In case the rotation of the visor 10 is more than $25^0$, the visor 10 is configured to be detached from the helmet 100 as will be explained hereinbelow. The normal condition is referred to a condition in which the visor 10 may experience a movement while the wearer/rider rides the vehicle. In such normal condition, no excessive external force, such as an impact is exerted on the helmet 100 and/or the visor 10.

Figure 11:
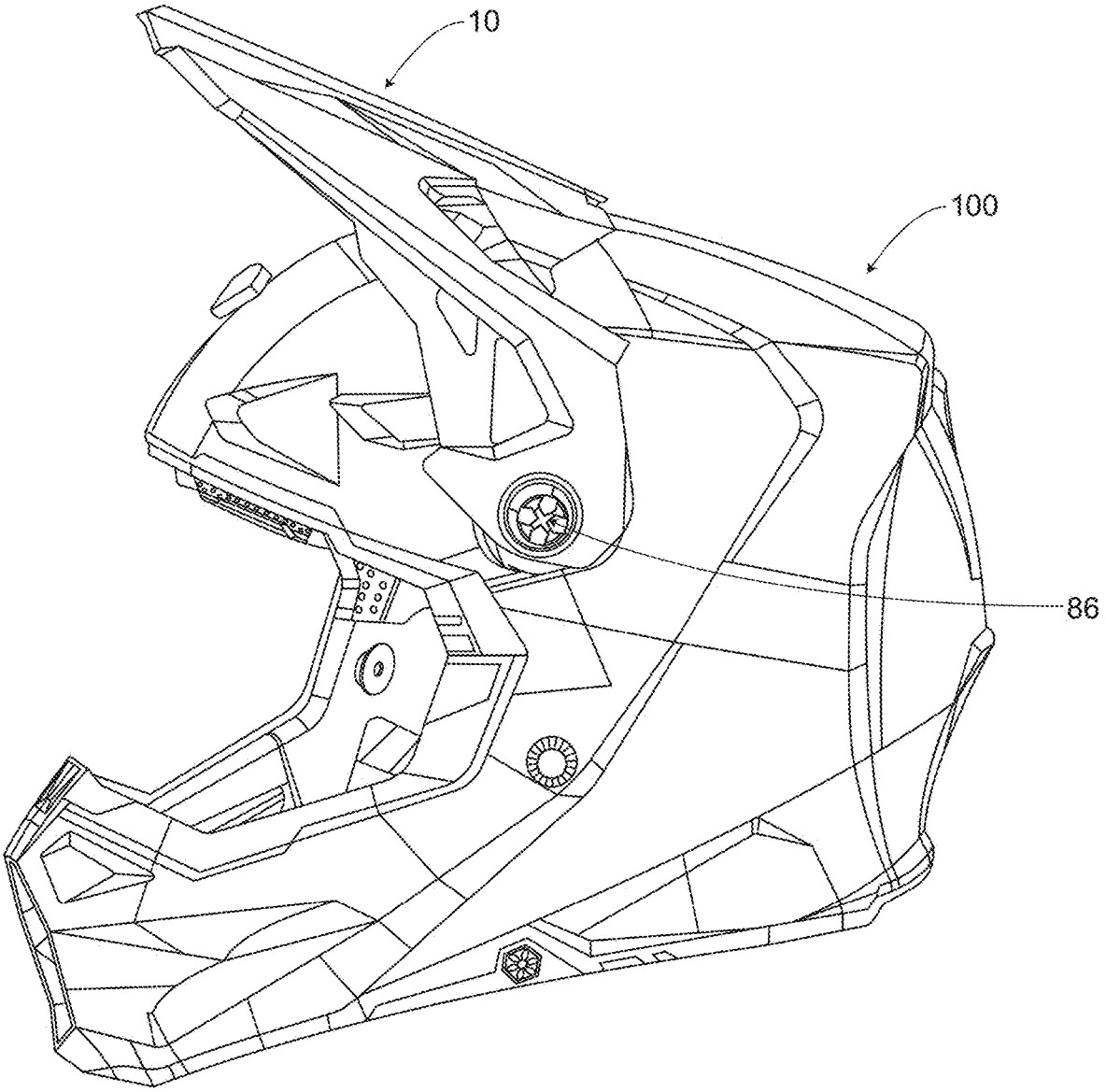
FIG. 11 illustrates an exemplary rotation of a visor in a helmet under excessive external force in accordance with the present disclosure.
Figure 12:
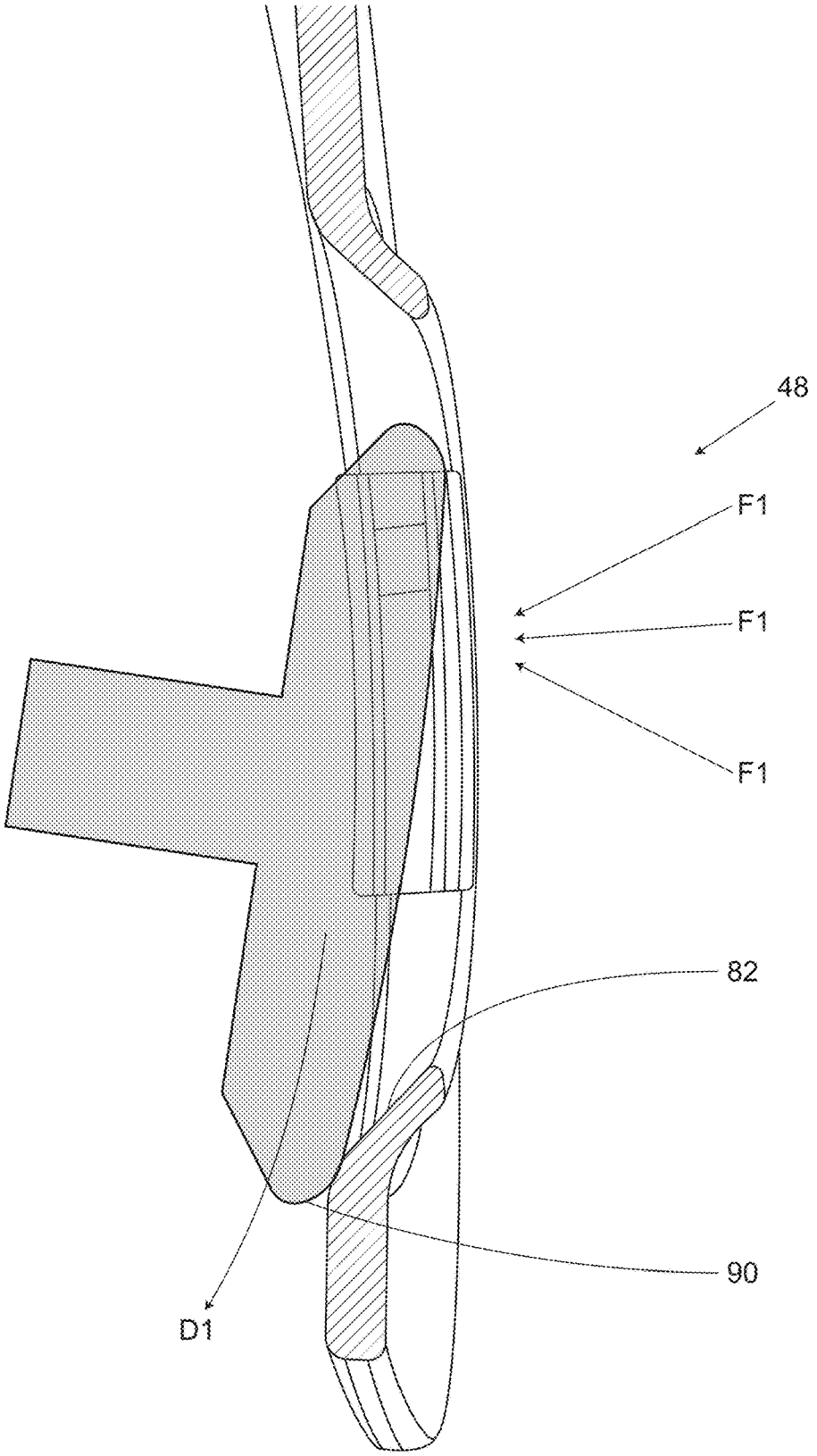
FIG. 12 illustrates an exemplary detachment of a screw at a side coupling mechanism of a visor from a helmet in accordance with the present disclosure.
Figure 13:
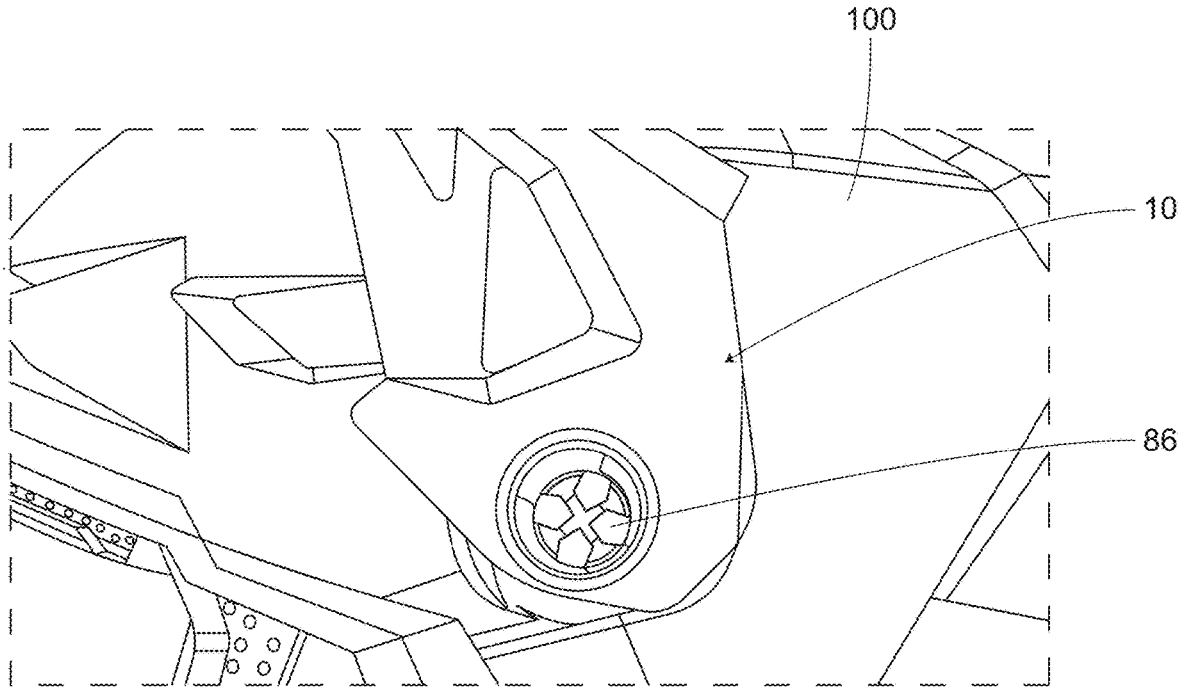
FIGS. 13-14 illustrate exemplary detachment of a visor from a helmet under influence of an external force in accordance with the present disclosure.
Figure 14:
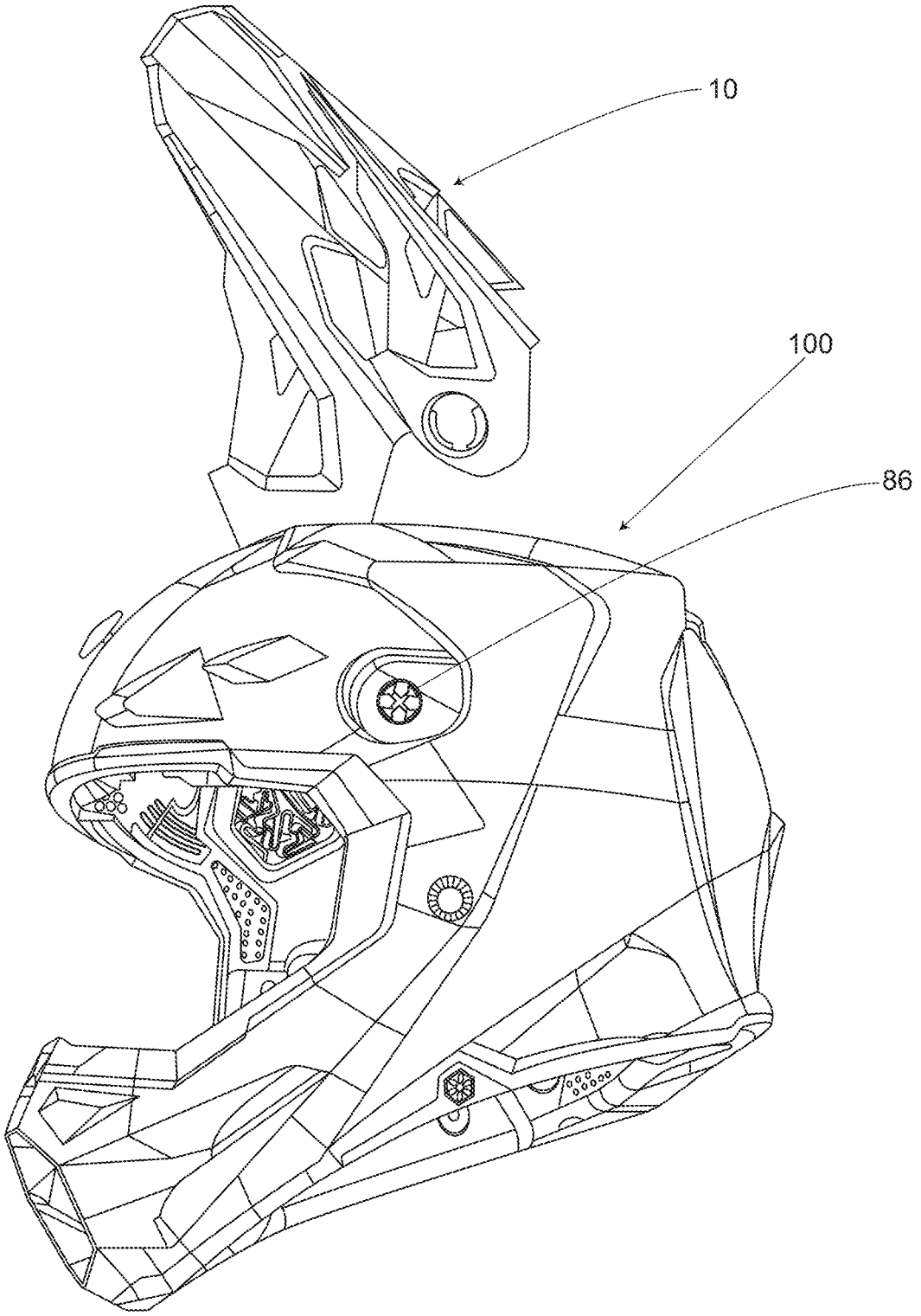

In event of application of a significant external force F1, the visor 10 may experience a shear force and the visor 10 may start moving upwards and back under the influence of the shear force (seen e.g., in FIG. 11). Under effect of such external force F1, the opening 52 of the side portion 40 of the visor 10 is configured to be easily detached from the helmet 100. More particularly, under effect of the external force F1, the screw 86 is configured to be detached from the visor 10, thereby detaching the visor 10 from the helmet 100. In other words, when an external force F1 is applied, the upward and rearward movement of the visor 10 causes the rearward portion of the central portion of the visor to push against a crown/hump H (seen e.g., in FIG. 10) of the helmet such that the visor is displaced upwardly relative to screw 86 in a disengaging direction D1 (seen e.g., in FIG. 12). In an embodiment, the disengaging direction D1 corresponds to the second surface 82 of the at least one cut-out portion 72. Accordingly, on application of the external force F1, the screw 86 slips through the opening 52 in the disengaging direction D1. The displacement of the screw 86 follows a path or a curve of the second surface 82 in the disengaging direction D1, causing detachment of the side portion 40 of the visor 10 from the helmet 100 (seen e.g., in FIGS. 13-14). Hence, the visor 10 is configured to be detached from the helmet 100 under influence of the external force F1 without damage to the helmet, screw, or visor. Accordingly, the disengagement of the side portion 40, and hence the visor 10, from the helmet 100 is easy and quick. Such disengagement does not exert any additional force on the visor 10, and hence, the visor 10 is configured to be disengaged without being broken.

The external force F1 may be exerted from any direction, for instance, from a front direction, a rear direction, or side directions. It is to be noted that the external force F1 from the side directions may be applied at any angle from the imaginary axis X.

As explained hereinabove, the side portion 40 of the visor 10 is configured to be attached with the helmet 100 by a snap fit or a simple push force against the screw 86 at the distal portion 48. Accordingly, after an accidental detachment of the visor 10, for instance under influence of the external force F1, the visor 10 is configured to be re-attached to the helmet 100 easily and quickly. The visor can often be replaced on a helmet after the break-away function is deployed without compromise to visor function.

It is to be noted that for easy attachment and detachment of the visor 10 from the helmet 100 using the screw 86, the screw 86 is specifically designed having the first screwhead curved surface 90 having a specific curve/slope corresponding to the second surface 82 of the at least one cut-out portion 72 of the opening 52 and the second screwhead curved surface 92 having a specific slope/curve corresponding to the first curved surface 68 of the at least one partial flange 58 of the opening 52.

In some embodiments, the visor 10 may further include a central attachment 20 (seen e.g., in FIG. 15) for coupling with a top central part 106 of a helmet 100. In such embodiments, the central portion 12 of the visor 10 comprises a rearward edge 14, a forward edge 16, and a front surface 18 and a rear surface 19 extending between the forward edge 16 and the rearward edge 14. In an embodiment, the central attachment 20 may be extended from the rearward edge 14 of the visor 10. In another embodiment, the central attachment 20 may be extended from the rear surface 19 of the central portion 12. The central attachment 20 may include a proximal end 26, a distal end 28, and two arms 30 extending from the proximal end 26. Optionally, the central attachment 20 may include a first part 22 and a second part 24 (seen e.g., in FIG. 15). In such embodiment, the first part 22 of the central attachment 20 may be configured to be extended from either the rearward edge 14 or the rear surface 19 of the central portion 12, and the second part 24 may comprise the two arms 30.

Figure 15:
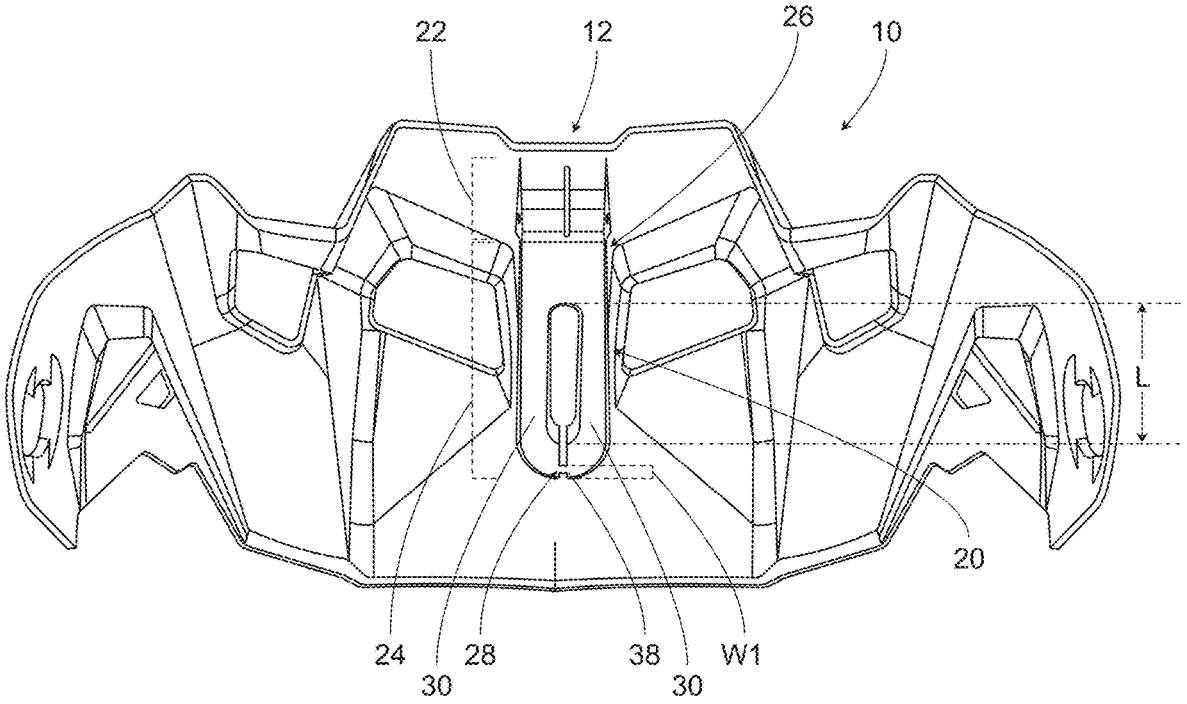
FIGS. 15-16 illustrate exemplary central attachment of a visor in accordance with the present disclosure.

The two arms 30 are configured to make a slot S therebetween (seen e.g., in FIG. 15). The two arms 30 are connected to each—other at the distal end 28. The slot S may be configured to be a hollow slot S and may have a length L. The slot S may be configured to receive a central screw 32 (seen e.g., in FIG. 16) therewithin. The slot S is configured to facilitate a rotation to the visor 10 up to a certain degree.

Figure 16:
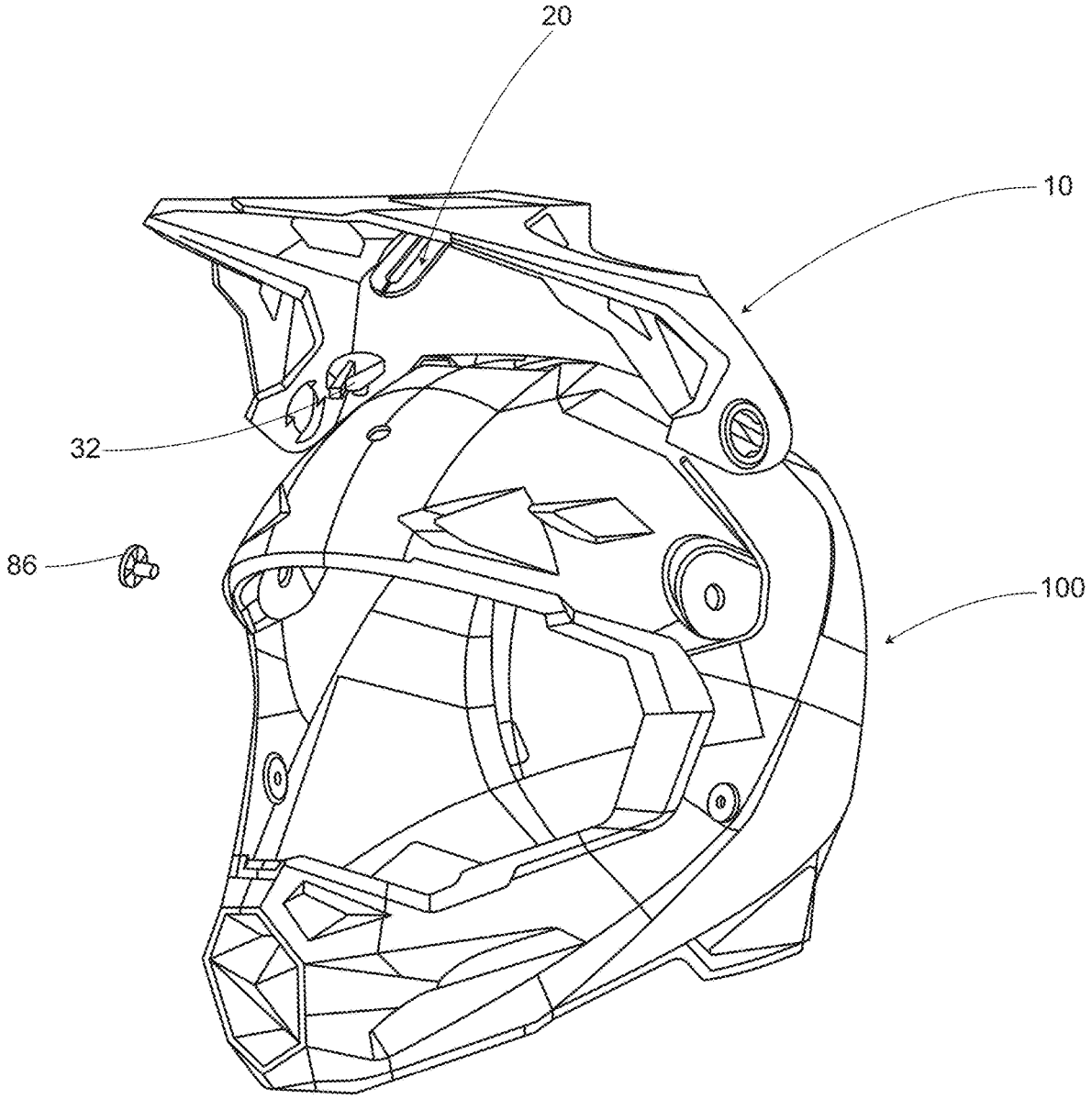

In some embodiments, the central screw 32 may be configured to couple the visor 10 with the helmet 100, and more particularly with the top central part 106 of the helmet 100. The central screw 32 includes a central screw 32 head and a central threaded rod. In an embodiment, the slot S between the two arms 30 is configured to receive the central threaded rod of the central screw 32 as seen in FIG. 16. In such embodiments, the central screwhead may be received on top surfaces of the two arms 30. The central attachment 20 may be configured to be coupled to the top central portion 12 of the helmet 100 via a first cavity of the top central portion 12 of the helmet 100. More particularly, the central attachment 20 may be configured to be coupled to the top central portion 12 of the helmet 100 by means of the center screw. For the same, threads of the central threaded rod may be configured to be received in the first cavity having a plurality of threads corresponding to the threads of the central threaded rod. For attaching the central attachment 20 with the helmet 100, the wearer/rider may position the central screw 32 and rotate the central threaded rod in the first cavity for tightening the central screw 32 therewith. In an embodiment, the central screw 32 may be rotated in a clockwise direction for tightening. In another embodiment, the central screw 32 may be rotated in an anticlockwise direction.

In some embodiments, the central attachment 20 may include a bridge 38 (seen e.g., in FIG. 15) at the distal end 28 for connecting the two arms 30. The bridge 38 may have a small width W1 and may be configured to restrict the displacement of the visor 10 within the slot S up to the length L. Optionally, the two arms 30 are connected with each other with a connecting part 25 and without the bridge 38 (seen e.g., in FIG. 4). In such embodiments, a width W2 of the connecting part 25 is high as compared to the width W1 of the bridge 38.

The central attachment 20 is configured to attach the visor 10 to the top central part 106 of the helmet 100. For attachment, the slot S of the central attachment 20 may be aligned to the first cavity of the top central attachment 20 and by passing the central screw 32 therewithin. The central attachment 20 is further configured to detach the visor 10 from the top central portion 12 of the helmet 100 in case of exertion of an external force F1. The external force F1 may be exerted on the visor 10 due to external forces such as a crash or other impact. The external force F1 may be exerted from any direction, for instance, from a front direction, a rear direction, or side directions.

In an embodiment of the central attachment 20 having the bridge 38, the bridge 38 may facilitate easy detachment of the visor 10 at the central portion 12 from the helmet 100. As explained hereinabove, in event of exertion of the external force F1, the visor 10 moves upward and rearward under influence of a shear force. When an amount of the external force F1 exceeds a predetermined value, the movement of the visor 10 increases, thereby increasing a degree of rotation. At the maximum degree, a crown/hump H (seen e.g., in FIG. 10) of the helmet 100 and the bridge 38 at the distal end 28 of the central attachment 20 restrict further rotation of the visor 10 and pushes back the visor 10 with an opposite force in an opposite direction. After a certain value of the external force F1, the visor 10 is not able to rotate further due to the opposite force of the hump and the bridge 38. In such situation, the bridge 38 is configured to be broken. The force required for breaking the bridge 38 is low as the width W1 of the bridge 38 is small. Accordingly, the external force F1 breaks the bridge 38 making the two arms 30 separate and allowing the central screw 32 to pass therethrough, thereby detaching the visor 10 at the central attachment 20 from the helmet 100. Hence, the visor 10 is configured to be detached from the central attachment 20 easily without being broken except for possibly the bridge. Breakage of the bridge is not destructive to the helmet and the central attachment 20 may still be fully used.

In an embodiment of the central attachment 20 having the connecting part 25, on exertion of an external force F1 on the visor 10, the connecting part 25 may not brake easily as compared to the bridge 38 (having the small width W1). In such embodiment, when an amount of external force F1 is high as compared to an allowable value, the hump and the connecting part 25 restrict rotation of the visor 10. In such embodiment, the connecting part 25 may not be broken easily as the width W2 is high as compared to the small width W1 of the bridge 38. In such embodiment, the central screw 32 is configured to be broken due to the external force F1 to release the visor 10 from the top central portion 12 of the helmet 100. Accordingly, the visor 10 is detached from the central attachment 20 easily without being broken.

In some embodiments, the visor 10 is made of a thermoplastic material. In a preferred embodiment, the visor 10 is made of nylon. However, any flexible material having similar properties as nylon may be used to make the visor 10. In some embodiments, the visor 10 may be made using a mold. A process of manufacturing the visor 10 may be a single step process.

In some embodiments, the central screw 32 may be made of plastic. Such central screw 32 made of plastic may be easily broken on exertion of the external force F1, thereby releasing the central attachment 20 of the central portion 12 from the top central attachment 20 of the helmet 100. Optionally or in addition, the screw 86 for attachment of the side portions may be made of plastic or aluminium.

It is to be understood that the description explains a side portion 40 and a coupling mechanism at one side, however, the coupling mechanism for coupling with a corresponding attachment at each of the first side and the second side of the helmet 100 has similar structure and work in a similar manner.

It is to be noted that different values and parameters mentioned in the description are exemplary in nature and are not intended to bound the specification in any manner.

Finally, while the present invention has been described above with reference to various exemplary embodiments, many changes, combinations, and modifications may be made to the exemplary embodiments without departing from the scope of the present invention. For example, the various components may be implemented in alternative ways. These alternatives can be suitably selected depending upon the particular application or in consideration of any number of factors associated with the operation of the device. In addition, the techniques described herein may be extended or modified for use with other types of devices. These and other changes or modifications are intended to be included within the scope of the present invention.

What is claimed is:

1. A visor to be rotatably attached with a helmet, the visor comprising:

a central portion having a forward edge and a rearward edge; and side portions extending from each side of the central portion;

each of the side portions comprising:

an inner surface;

an outer surface opposite to the inner surface;

a proximal portion extending from a corresponding one of the sides of the central portion; and a distal portion having a side coupling mechanism to be rotatably attached with the helmet, the side coupling mechanism including an opening and at least one partial flange in at least a first portion of the opening, the opening having a perimeter and an open central area having a middle;

wherein the at least one partial flange comprises a first edge, a second edge, wherein the first edge is closer to the middle of the open central area than the second edge, and a surface extending between the first edge and the second edge, the surface between the first and second edges being sloped as it holds the distal portion to the helmet.

2. The visor of claim 1, comprising a central attachment extending from the central portion, the central attachment comprising having two arms extending from a proximal end of the central portion, the two arms configured to make a slot therebetween.

3. The visor of claim 2, wherein the central attachment comprises a bridge adjacent to a distal end of the central portion, the bridge configured to connect the two arms.

4. The visor of claim 1, wherein the at least one partial flange extends between the inner surface and the outer surface to circumscribe the first portion of the opening.

5. The visor of claim 4, wherein the first edge corresponds to the inner surface and the second edge corresponds to the outer surface.

6. The visor of claim 1, wherein the opening comprises at least two opposing partial flanges.

7. The visor of claim 1, wherein the first portion corresponds to less than a half of a circumference of the opening.

8. The visor of claim 1, wherein the opening further comprises at least one cut-out portion in at least a second portion thereof.

9. The visor of claim 8, wherein the at least one cut-out portion extends between the outer surface and the inner surface, the at least one cut-out portion comprising a first cut-out edge forming a portion of a first circle and having a second inner diameter, a second cut-out edge forming a portion of a second circle and having a second outer diameter, and a second surface extending between the first cut-out edge and the second cut-out edge.

10. The visor of claim 9, wherein the second inner diameter corresponds to the inner surface and the second outer diameter corresponds to the outer surface.

11. The visor of claim 9, wherein the second outer diameter is low as compared to the second inner diameter.

12. The visor of claim 9, further comprising a fastener having a fastener head configured to slip through the opening in a disengaging direction D1 corresponding to the second surface, on application of the external force, to detach the visor from the helmet.

13. The visor of claim 1, wherein the at least one partial flange is configured to receive a screw therewithin.

14. The visor of claim 13, wherein the first curved surface of the at least one partial flange is configured to receive at least a first portion of a second screwhead curved surface of the screw.

15. The visor of claim 13, wherein the opening comprises at least one cut-out portion in at least a second portion thereof, the at least one cut-out portion extending between the outer surface and the inner surface, the at least one cut-out portion comprising a first cut-out edge, a second cut-out edge, and a second surface extending between the first cut-out edge and the second cut-out edge.

16. The visor of claim 15, wherein the second surface of the at least one cut-out portion is configured to abut a second partial portion of a first screwhead curved surface of the screw.

17. A helmet visor for securement to a helmet, the helmet visor comprising:

a central portion for attachment with the helmet;

a central attachment extending from the central portion; and right side member and left side member extending outwardly from the central portion, each of the right-side member and the left-side member having an inner surface, an outer surface, and an opening to receive a screw, the opening including:

a partial flange having inner and outer edges that form portions of circles, the inner edge having an inner diameter positioned towards the inner surface and the outer edge having an outer diameter positioned towards the outer surface, the inner diameter being smaller than the outer diameter;

wherein the central attachment comprises two arms extending from a proximal end of the central portion, the two arms configured to make a slot therebetween;

wherein the central attachment further comprises a bridge adjacent to a distal end of the central portion, the bridge is configured to connect the two arms; and wherein the bridge is configured to be broken on application of the external force to detach the visor at the central position from the helmet.

18. The helmet visor of claim 17, wherein the opening comprises at least two opposing partial flanges.

19. The helmet visor of claim 17, wherein the partial flange circumscribes a portion of the opening having less than a half of a circumference thereof.

20. The helmet visor of claim 17, wherein the partial flange comprises a first curved surface extending between a first edge of the first inner diameter and a second edge of the first outer diameter, the first curved surface configured to abut a second screwhead surface of the screw, thereby supporting the screw within the partial flange.

21. The helmet visor of claim 17, wherein the opening further comprises at least one cut-out portion having a second inner diameter positioned towards the inner surface and a second outer diameter positioned towards the outer surface, the second outer diameter being smaller than the second inner diameter.

22. The helmet visor of claim 21, wherein the at least one cut-out portion comprises a second surface extending between a first cut-out edge of the second inner diameter and a second edge of the second outer diameter, the second surface configured to abut a first screwhead surface of the screw.

23. A visor to be rotatably attached with a helmet, the visor comprising:

a fastener securable to the helmet, the fastener including a head;

a central portion having a forward edge and a rearward edge; and side portions extending from each side of the central portion;

each of the side portions comprising:

an inner surface;

an outer surface opposite to the inner surface;

a proximal portion extending from a corresponding one of the sides of the central portion; and a distal portion having a side coupling mechanism to be rotatably attached with the helmet, the side coupling mechanism including an opening and at least one partial flange in at least a first portion of the opening, the at least one partial flange having a length extending in a circumferential direction that is greater than a thickness of the at least one partial flange, the thickness extending in the direction of the inner surface to the outer surface, the distal portion further including a second portion adjacent the at least one partial flange, the second portion forming a portion of a perimeter of the opening;

wherein the at least one partial flange includes a first sloped face partially defining the first portion of the opening, the first sloped face facing at an angle towards the outer surface, the first sloped face releasably engaging with the fastener head; and wherein the second portion includes a second sloped face at an angle facing towards the inner surface, the second sloped face releasably engaging with the fastener head.

24. The visor of claim 23, wherein the length of the at least one partial flange is at least twice the thickness.

25. The visor of claim 23, wherein the at least one partial flange comprising a first edge forming a portion of a first circle and having a first inner diameter, a second edge forming a portion of a second circle and having a first outer diameter, wherein the first inner diameter is less as compared to the first outer diameter.

26. The visor of claim 25, wherein a first curved surface extending between the first edge and the second edge, the first curved surface configured to have a first curve.

27. The visor of claim 26, wherein the first inner diameter corresponds to the inner surface and the first outer diameter corresponds to the outer surface.

28. The visor of claim 23, wherein the opening comprises at least two opposing partial flanges.

29. The visor of claim 23, wherein the opening further comprises at least one cut-out portion in at least a second portion thereof, the cut-out portion forming the second portion and the second sloped face.

30. The visor of claim 29, wherein the at least one cut-out portion extends between the outer surface and the inner surface, the at least one cut-out portion comprising a first cut-out edge having a second inner diameter, a second cut-out edge having a second outer diameter, and a second surface extending between the first cut-out edge and the second cut-out edge.

31. The visor of claim 30, wherein the second inner diameter corresponds to the inner surface and the second outer diameter corresponds to the outer surface.

32. The visor of claim 30, wherein the second outer diameter is less as compared to the second inner diameter.

* * * * *